United States Patent [19]

Koyama et al.

[11] 4,075,812

[45] Feb. 28, 1978

[54] REFRACTORY CHECKERWORK

[75] Inventors: Yasujiro Koyama, Yokohama; Fukuichi Kitani, Kawasaki; Masaaki Nishi, Fukuyama, all of Japan

[73] Assignee: Nippon Kokan Kabushiki Kaisha, Tokyo, Japan

[21] Appl. No.: 629,115

[22] Filed: Nov. 5, 1975

[30] Foreign Application Priority Data

Nov. 8, 1974 Japan ..... 49-128093

[51] Int. Cl.[2] ..... F23M 5/00

[52] U.S. Cl. ..... 52/747; 52/573; 52/612; 110/1 A; 165/9.1

[58] Field of Search ..... 52/408, 503, 505, 573, 52/596, 606, 612, 747; 110/1 A, 1 B; 165/9.1, 9.2, 9.3, 9.4; 432/247, 251

[56] References Cited

U.S. PATENT DOCUMENTS

| | | | |
|---|---|---|---|
| 2,047,227 | 7/1936 | Robinson | 52/596 |
| 2,764,398 | 9/1956 | Herman | 52/606 |
| 2,833,532 | 5/1958 | Ries | 52/604 |
| 2,853,872 | 9/1958 | Samuel | 110/1 B |

FOREIGN PATENT DOCUMENTS

| | | | |
|---|---|---|---|
| 923,690 | 4/1963 | United Kingdom | 165/9.3 |

*Primary Examiner*—Price C. Faw, Jr.
*Assistant Examiner*—Henry Raduazo
*Attorney, Agent, or Firm*—Moonray Kojima

[57] ABSTRACT

The refractory checkers can be saved from damage or breakdown by introducing a layer of a material having suitable compressive deformability, between overlapping brick surfaces.

6 Claims, 6 Drawing Figures

REFRACTORY CHECKERWORK

The present invention concerns a checkerwork and more particularly the invention aims at uniform distribution of the load concentrated at the overlaying surfaces of the refractory checkers in order to adroitly prevent damage and breakdown of the refractory checkers.

As is well known, the refractory checkerwork is the main structure of a regenerator which preheats combustion air or gas supplied to blast furnace, open hearth, glass melting furnace or gas denaturing furnace. In the conventional art, various types of checker-building shapes for use in a regenerator are known. For instance, dry masonary using no joint material and building straight or corrugated bricks in parallel crosses or the building of bricks having openings for allowing gas passages in a column shape or in an overlapping manner are well known. In recent years, the improvements in shape and material of the checker and in furnace building technique contributed toward the gradual betterment of performance, particularly so in the hot blast stove, resulting in a great volume blast at a high temperature and under a high pressure. In such a large sized hot stove, bricks of a higher quality are used, as compared with the conventional type small or medium sized stoves. Despite the use of higher grade bricks and many such improvements in structure, the life of such large sized hot blast stoves is very short (shorter than that of the blast furnaces in many cases) and its economic disadvantages are keenly felt.

Various investigations have been carried out to ascertain the cause of the short life of the hot stove, and such investigations have revealed that the short life is mainly caused by damage and breakdown of the checkerwork based on the more severe operational conditions and the larger sized furnace structures of the recent times. Such damages of the checkerwork increase pressure loss to the gas stream, thereby lowering the blast temperature and its volume being supplied, and the sinking of the checkerwork damages the portion of the side wall exposed to the high temperature and causes hot spots in the upper shell. However, there has been no practical measures to be taken against such damage and breakdown of the checkerwork so far. The features of this invention lie in the introducing of a material having suitable compressive deformability between overlapping brick-surfaces. Thus, the checkers are prevented from being damaged or broken down.

An object of this invention is to provide a refractory checkerwork which is not damaged easily or broken down easily.

Another object of this invention is to provide a refractory checkerwork having at least the same level of longevity as that of the blast furnace itself.

Other objects and advantages will be apparent from the following description and with the accompanying drawings in which.

In the prior art, possible causes for failures (i.e. damage or breakdown) to the refractory checkers in large scale hot blast stove were classified into two regions namely, the upper and lower portions of the checkers. In the upper portion the damages were considered to have been eroded by dust in the combustion gas and deformed by compressive-creep caused by the weight of the bricks under high temperature, whereas in the lower part, deterioration of the strength or breakdown of the brick were contributed to the thermal expansion and contraction caused by burning and blast and the periodical transformations of restraining stress of the shell against the expansion. However, the experiments and researches conducted by the inventors of this invention revealed that the failures of the checkers are mainly a damage - breakdown of the checkerwork itself in the regenerating chamber, particularly of its lower half, and their causes were found to be subject to the points enumerated below in addition to those above mentioned.

Firstly, compressive strength of the brick checker itself is remarkably small when compared to the value obtained by measuring a test piece with precise dimensions. The data are concretely shown in Table 1.

Table 1

| | Fire clay brick | High alumina brick |
|---|---|---|
| compressive strength in the direction of height of one brick ($kg/cm^2$) | 200 - 350 | 270 - 410 |
| Compressive strength of the test piece ($kg/cm^2$) | 450 - 650 | 550 - 800 |
| Tensile strength ($kg/cm^2$) | mean 35 | mean 60 |

Figure 1:
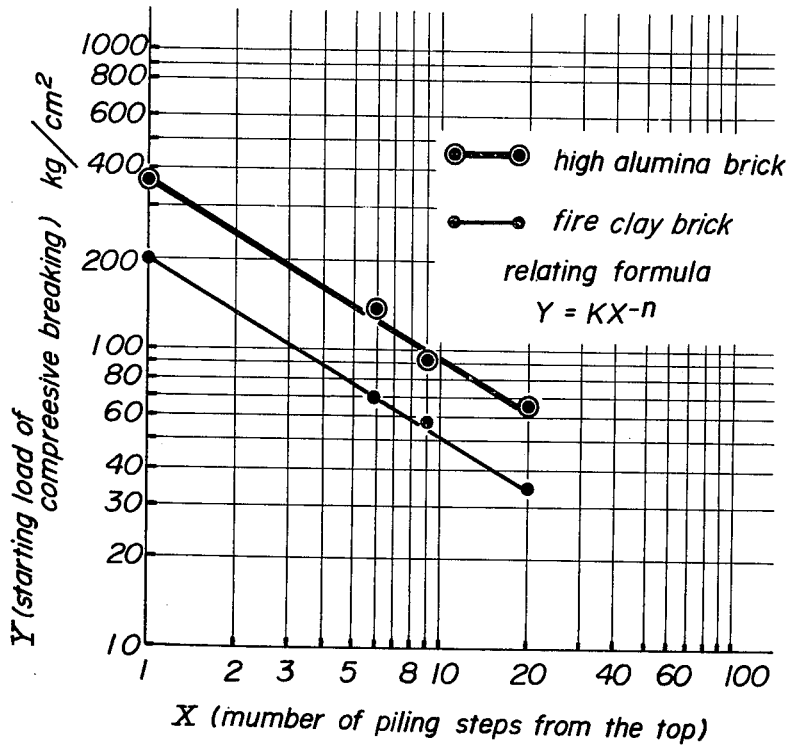
FIG. 1 depicts the relationship between piling steps of brick and amount of starting load of its compressive failure.

Secondly, the greater the number of layer of brick, the lower the starting load causing compressive breaking. The results of the Test are shown in FIG. 1. From the above test results, it is known that the failures (damage - breakdown) of the checkers occur because the compressive load concentrates tolerance of the checkerwork height in a portion showing maximum value, which is within the dimensional tolerance of the checkerwork, thus causing shearing breakdown between the compressed portion and non-compressed portion, and the elongation orthogonal to the direction of compression causes tensile breaking. Moreover, it was found that the accumulation of such concentrated load along with increased number of the piling steps increase instability in the overall elasticity of the checkerwork.

Taking note of the discovered features on the structural strength of the checkerwork, the present invention has been developed as mentioned above.

Figure 2:
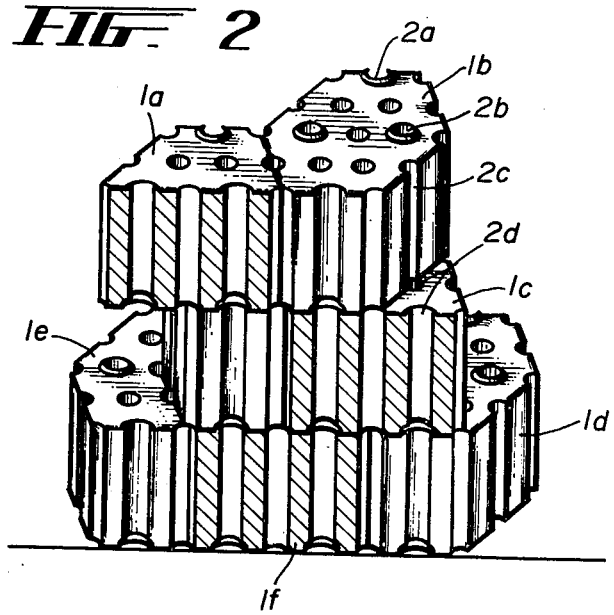
FIG. 2 is an example showing a partial section of checkerwork.
Figure 3:
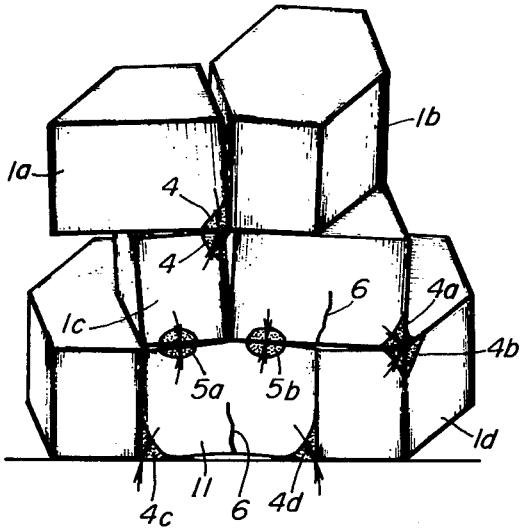
FIG. 3 shows an example of partial section of a prior checkerwork.
Figure 4:
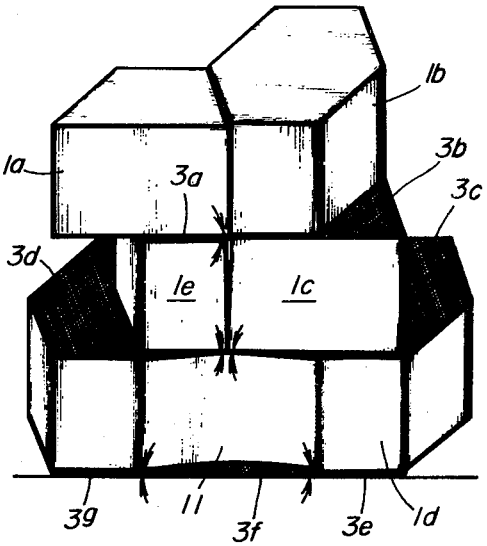
FIG. 4 shows an example of partial section of gitter brick checkerwork based on this invention.

In elucidating the present invention further, reference is now made to the drawings, in which FIGS. 2 to 4 show the partial of sections of the checkerwork composed of overlapping steps. (1) denotes a brick of the checkerwork and (2), a gas passage hole. FIG. 2 shows a checkerwork with an assumption that there is no dimensional error therein, whereas in practice there are errors in the dimensions of the bricks as shown in the brick 11 in FIG. 3. Thus, there is concentrated load as shown with the arrows around the brick 11, which often gives rise to chipped corncers 4*a*, 4*b*, 4*c*, 4*d*, bricks 1*a* and 1*b* joining each other transversly becomes greater. As shown in FIG. 4, the present invention placed heat resistant or refractory material layers having a suitable compressive deformability in the direction of thickness between the bricks facing each other, 1*b*-1*c* or 1*c*-1*d*, etc, and the introduced heat resistant or refractory material layers having compressive deformability (hereinafter referred simply as introducing layers) 3*a*, 3*b*, 3*c*, 3*d*, 3*e*, 3*f*, 3*g* and so on, absorb the allowable errors in the shape and dimension of the bricks and achieve the overall elastic stability. FIG. 4 shows one embodiment of the present invention, but the invention is naturally not to be limited by shape of the bricks or method of checkerwork as shown in the drawings.

The thickness of the introducing layer 3*a*, 3*b*, etc, composed of a material as mentioned later, is determined by considering the compression curve of the material, dimensional tolerance in the direction of height, breaking strength, distribution in the direction of radius on the pressure receiving area, the uneveness distribution of the pressure receiving surface and rate of the concentrated load area under pressure [(the actual pressure receiving area the planning total pressure receiving area) × 100%]. However, such a method tends to complicate matters so much and the following method of computation is more convenient and practical.

Figure 5:
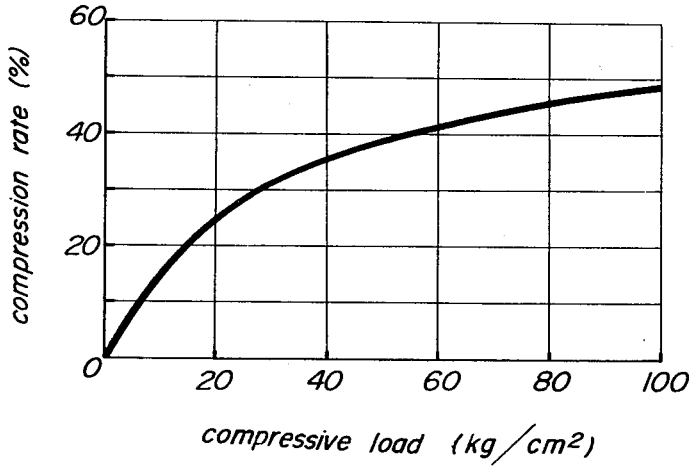
FIG. 5 is an example of a compressive curve of a compressive deformable material based on this invention.
Figure 6:
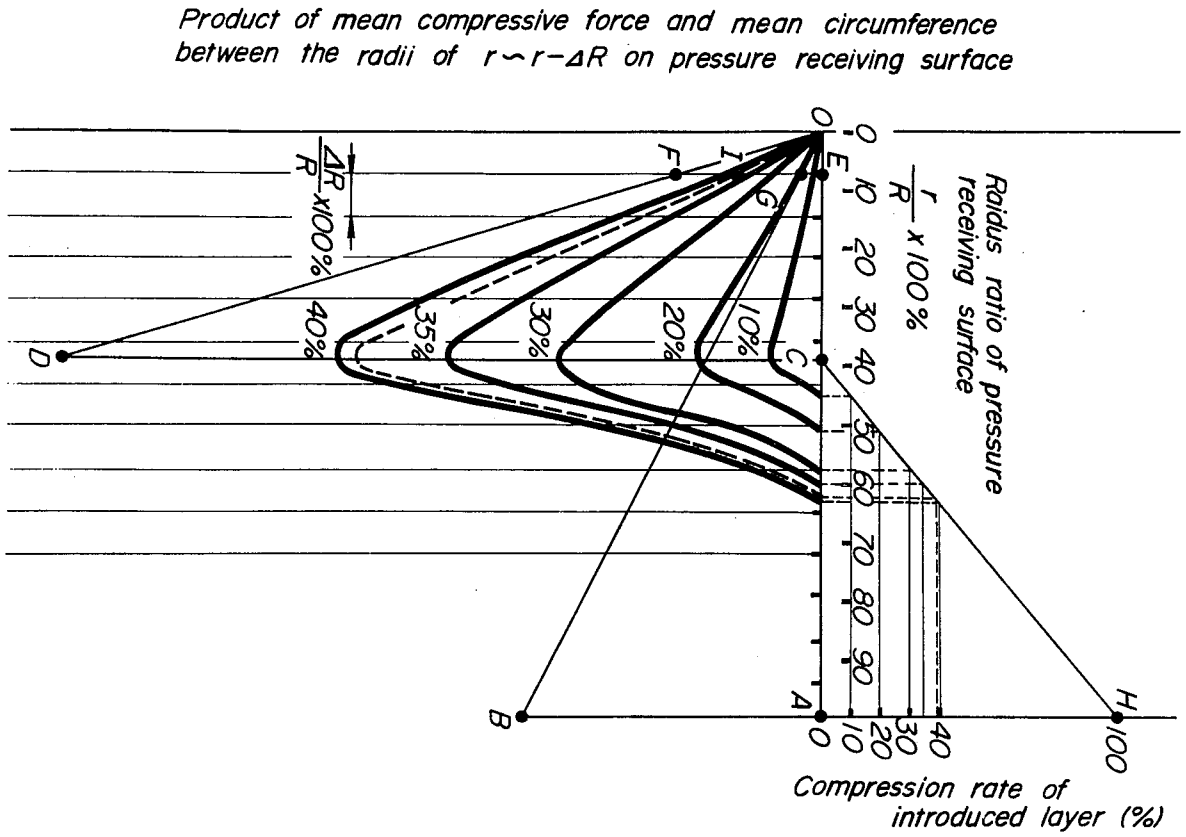
FIG. 6 shows the estimated explanatory diagram of concentrated compression load when the material having compressive deformability is employed in accordance with this invention.

The materials having compression deformability are to be selected considering such employed requirements as temperature, atmosphere, etc, and its compression curve is measured as illustrated in FIG. 5. On the other hand, the compressive stress generating to the various portions of the bricks is measured by applying the compressive load (about 1/5 of the tensile strength) just sufficient enough to cause no cracks to a block piling the checkerwork by a few steps and ratio of the compressive load (equivalent to the rate of load concentrating area) as against its maxium value is sought, from which is calculated a ratio of apparent radius Ar% of the load concentrating area said Ar% used herein means the value represented in percentage of the ratio of the radius of the load concentrating area as against the radius calculated from the planning total area receiving pressure being calculated based on the assumption that a uniform area density exists in the direction of radius on the pressure receiving surface.

Based on the values thus obtained, the apparent radius ratio of the pressure receiving area ($r/R \times 100\%$) is plotted on the abscissa and the product of mean compressive force and mean circumference, between the radii of $r - r - \Delta R$ on the pressure receiving surface is plotted in the negative direction from the origin on the ordinate, while the compression ratio (%) of material having compressive deformability is plotted on the ordinate in the positive direction from the other origin on the abscissa. Supposing that the whole surface receiving pressure shows a uniform distribution state of the load, the abscissa is divided by the radius ratio of an arbitrary unit (such as radius ratio of a circle with an area of $1cm^2$, length of OE), and the straight line OB is drawn by determining a unit of the ordinate so as to make the load being applied to the pressure receiving surface in the respective partition equal to the area below the respective partition. In such a manner, ΔOAB will represent the total load being applied to one piece of brick while ΔOEG will represent the load (compression force) per unit area. When OC equals Ar is plotted on the abscissa and a perpendicular line is drawn from the point C in the direction of ordinate to draw ΔOCD with OC as the base and with its area being equal to that of ΔOAB, ΔOEF will represent the compressive force in case of the total concentrated load on the surface with an apparent radius ratio, Ar. On the other hand, assuming that the load concentrating surface is distributed in the center of the pressure receiving surface and that the gap between the two surfaces of the overlapping bricks from its outer periphery toward the edge of the total pressure receiving surface extend with a uniform gradient, the distance between the said two surfaces is plotted in the positive direction of the ordinate from the origin O, then the straight line CH will represent the size of gaps on respective radii (provided that the compressive force on the load concentrating surface is in a uniform state). When AH is plotted equal to the dimensional tolerance in the brick height and the introducing layer (made of a material having compressive deformability) of the same thickness as the said tolerance was used, the total load working on the respective partitions of the apparent radius in a case where the introducing layer at the load concentrating portion, OC, reaches the abritrary compression rate (indicated on AH in the figure), is calculated from the mean compressive force of the introducing layer (to be sought from the compression curve in FIG. 5) and the area. When these values are represented by the columnar area below the abscissa in respect of the respective partitions in the drawing and connected with smooth curve, the curves in the figure will have been achieved. The area partitioned by these curves and the abscissa will represent the total load applied to the brick in a certain compressed state, so that when its area becomes equal to ΔODC, on which reference was made before (shown by the broken line in the drawing), the total compressive force working on the introducing layer and the total load represented by ΔOAB become balanced. In other words, ΔOEI represents the maximum compressive force in a case where the introducing layer were used which is about half of the compressive force ΔOEF in a case of no introducing layer.

The scope of safety required against the maximum compressive force in a case where the introducing layer is estimated as mentioned above may be such that it is less than 2 times of the tensile strength of brick or preferably less than 1.5 times, speaking empirically. Accordingly the compressive force should be selected from within the said scope in the combination of thickness of the introducing layer and the compression curve.

Quality of material of the introducing layer may be arbitrarily selected depending upon the dimensional tolerance, breaking strength of the checker, load concentrating degree of the checkerwork (rate of load concentrating area), operating during use and atmospheric requirements. An example of the materials is such a fibrous material as various ceramic fiber, asbestos, slag — or glass wool, metallic wool or — wire; or such a material as felt, plate, cloth, paper, net or paste which is prepared from squama, sheet or foil of mica, vermiculite squamate graphite or metallic sheet or foil. And then the introducing layer is composed as single or laminating structure with one or more of the above materials.

The introducing layer such as mentioned above are executed by introducing or sticking a material of about the same shape as overlapping face of the bricks at the furnace-building stage in a case where a felt- or net-like material is employed as the above layer, or by pre-sticking by organic or inorganic adhering agent before furnace-building. In many cases, cornstarch is preferred as the above adhering agent because it does not generate noxious gas under heating and operating and it does not chemically react with the brick. When a paste of material is employed as the introducing layer, it is preferable to coat or spray the same on the bricks and dry them for easier handling. However, it is possible to coat or spray the layer at the furnace building stage, if neceaary. It is important to let the effect of the present invention become fully exerted by making the introducing layer as uniformly thick as possible.

As for the employing scope of the introducing layer in the checkerwork, they may be used as extensively as on the whole portion of lower half of the checkers in view of the failure of the checkers on which reference has already been made, but it is preferable, cost-wise, to limit the use to the required minimum. The employing scope of the introducing layer, therefore, should be determined by the requirements of an actual furnace and on the relation between number of piling steps and the starting load of compression breaking based on the checkers weight shown in FIG. 1, that is, setting the limit of a number of said piling steps (counting from the bottom) at which the checkers weight exceeds the said starting load of compression breaking, or number of piling steps at which 7 times the compressive force based on the cherckers weight (the empirical upper limit of the load concentration) corresponds to 1.5 times the tensile strength of the brick.

Illustrating an actual example of the above explanation (thickness of material, the executing method and the employing scope, in the checkers (regenerating chamber) of a hot-blast stove, it is stated that ordinary checker bricks are used and stacked in 259 steps, and 2 mm thick asbestos paper is used as an introducing layer, placing the same between the respective overlapping faces of the checkerwork starting at the 194th layer downward (66th steps counting from the bottom), which the paper is stacked on the brick surfaces with cornstarch in advance.

The results of the test on compression behaviour applying the present invention to the building of the checkerwork are shown along with that using the checkerwork based on the conventional method. The tested checkerwork used Freyn type fire clay bricks and high alumina bricks for actual furnace, stacked in an over-lapping manner (where parts of the three bricks were stacked overlapping on one brick) using nine pieces of bricks per one step in nine steps. A strain gauge was attached to measure the stress generating in various portions of the checkers and 30 mm thick asbestos board were introduced on the surface and bottom of the checkerwork where the vertical pressure worked in order to avoid concentration of load between the resisting pressure steel plate of the pressure device and the brick.

The dimensional tolerance in the height of brick is ± 1 mm, and the rate of the load concentrating area is 15% for fire clay brick and 20% for high alumina brick. From the design requirements of a stove using these bricks, the maximum static load generated to the checkerwork under uniform load distribution was 12.8 kg/cm$^2$ for the clay brick and 13.3 kg/cm$^2$ for the high alumina brick. In the case of the present invention, 2 mm thick asbestos paper having the compression curve as that shown in FIG. 5 was used as the introducing layer.

Using the test requirements as mentioned above, rate of the load concentrating area and compressive load at the load concentrating portion of the checkers were assumed and shown in Table 2.

Table 2

| items tested | fire clay brick | | high alumina brick | |
|---|---|---|---|---|
| | conventional type | present invention type | conventional type | present invention type |
| rate of load concentrating area (%) | 15 | 26 | 20 | 31 |
| mean compressive load at load concentrating area (kg/cm$^2$) | 85 | 50 | 66 | 42 |

As is clear from Table 2, the conventional type not using the introducing layer showed the mean compressive load exceeding 1.5 times of the tensile strength (refer to Table 1) at the load concentrating portion of the fire clay brick, thus demonstrating a high probability for vertical cracks, whereas in the present invention type which provides for the introducing layer on the overlapping faces of the checkers, the compressive load at the load concentrating portion is small and eliminates possibility for the above vertical cracks.

Table 3 shows the results of the normal compression test of the checkerworks under the requirements described before.

Table 3

| | fire clay brick | | high alumina brick | |
|---|---|---|---|---|
| | conventional type | present invention type | conventional type | present invention type |
| starting load of vertical crack (kg/cm$^2$) | 11.2 | 27.9 | 16.7 | 33.5 |
| starting load of compressive breaking (kg/cm$^2$) | 7.1 | 148 | 118 | 183 |
| rate of load concentrating area (%) | 15 | 45 | 20 | 55 |

As is clear from Table 3, the checkerwork according to the present invention shows 2.5 and 2 times of the starting load of those of the conventional art at which the vertical cracks appear for the fire clay brick and the high alumina brick respectively, and 2.1 times and 1.5 times for the starting load at which compression breaking appears, and finally 3 times and 2.7 times for the rate of load concentrating area, respectively, thus demonstrating the remarkable effects in preventing the failures to the checkerwork. The concurrance of the results of the assumption made in Table 2 and of the normal test in Table 3 on the starting load at which vertical cracks begin to appear endorses applicability of the rate of load concentrating area which is measured under the load not leading to failure to the scope of load in actual use. When the examined value (Table 3) of the rate of load concentrating area with the introducing layer is compared with the assumed value (Table 2), the former is about 2 times more than the latter. This is because the maximum value was used as the dimensional tolerance for the brick in the calculation for the assumed values and the most severest requirement such as one spot for the load concentrating portion of one brick was applied, thus demonstrating the assumption on the safety side.

As has been demonstrated hereinabove, the present invention is characterized in that the uniform distribution of the concentrating load generating on the overlapping checker brick faces in the checkerwork for the regenerator is aimed, thus suitably eliminating the possible damage and breakdown of the checkerwork which so far had been imposing grave problems in the prior art.

We claim:

1. A method of determining the thickness of a compressible layer of material between overlapping faces of checker work bricks, comprising the steps of (A) determining the compressibility of the material to be used in said layer;

(B) obtaining the amount of compressibility of said layer at 1.5 to 2.0 times the tensile strength of said bricks;

(C) measuring the maximum dimensional tolerance between overlapping bricks;

(D) determining the amount of compressibility required to disperse a maximum safety load throughout the maximum dimensional tolerance; and (E) letting the thickness of said layer equal the said dimensional tolerance times the said amount of compressibility required to disperse a maximum safety load divided by the said amount of compressibility at 1.5 to 2.0 times the tensile strength.

2. The method of claim 1, wherein said amount of compressibility of said layer is determined at 1.5 times the tensile strength of said bricks.

3. The method of claim 1, wherein said compressible layer comprises a fibrous material selected from the group consisting of ceramic fiber, asbestos, slag, glass wool, metallic wool, metallic wire and any combination of the foregoing.

4. The method of claim 1, wherein said compressible layer comprises mica, vermiculite or squamate graphite.

5. The method of claim 3, wherein said material used in said compressible layer is prepared with the same shape as an overlapping face of said checkerbricks.

6. The method of claim 4, wherein said material used in said compressible layer is prepared with the same shape as an overlapping face of the checkerbricks.

* * * * *